US006920691B2

(12) United States Patent
Ham

(10) Patent No.: US 6,920,691 B2
(45) Date of Patent: Jul. 26, 2005

(54) MULTI CELL TUBE AND MANUFACTURING METHOD

(76) Inventor: Ui-Shin Ham, 12-88 Bangbae-bondong, Seocho-gu, Seoul (KR)

( * ) Notice: Subject to any disclaimer, the term of this patent is extended or adjusted under 35 U.S.C. 154(b) by 22 days.

(21) Appl. No.: 10/472,007

(22) PCT Filed: Mar. 29, 2002

(86) PCT No.: PCT/KR02/00553

§ 371 (c)(1),
(2), (4) Date: Sep. 15, 2003

(87) PCT Pub. No.: WO02/079054

PCT Pub. Date: Oct. 10, 2002

(65) Prior Publication Data

US 2004/0098807 A1 May 27, 2004

(30) Foreign Application Priority Data

Mar. 29, 2001 (KR) ..... 2001-16442

(51) Int. Cl.[7] ..... B21D 51/16
(52) U.S. Cl. ..... 29/890.144; 29/463
(58) Field of Search ..... 29/890.14, 890.144, 29/428, 463; 141/1, 11, 114; 5/710–713

(56) References Cited

U.S. PATENT DOCUMENTS 5,596,778 A * 1/1997 Suzuki et al. ..... 5/502
5,699,570 A * 12/1997 Wilkinson et al. ..... 5/713
5,920,934 A * 7/1999 Hannagan et al. ..... 5/713
5,956,787 A * 9/1999 James et al. ..... 5/713
6,317,912 B1 * 11/2001 Graebe et al. ..... 5/710

* cited by examiner

*Primary Examiner*—Timothy L. Maust
(74) *Attorney, Agent, or Firm*—Galgano & Burke, LLP

(57) ABSTRACT

A method of manufacturing a multi-cell tube having two or more cells, which are repeatedly formed in longitudinal and circumferential directions of the tube in such a manner that fluid can be separately or simultaneously let into and/or out of the respective cells. The multi-cell tube comprises a cell unit including a plurality of cells arranged in one direction of the tube and have corresponding inlets in a direction intersecting with the direction in which the cells are arranged; a supply tube unit which has an opening/closing valve at any one side end thereof and communicates with the inlets of all the cells in a state where the supply tube unit is close to the cells; and an operating tube unit, made of inflatable material (e.g. rubber, plastics or the like), which is installed within the supply tube unit, and has an opening/closing valve at any one side end thereof.

3 Claims, 13 Drawing Sheets

MULTI CELL TUBE AND MANUFACTURING METHOD

TECHNICAL FIELD

The present invention relates to a multi-cell tube capable of simultaneously opening and closing a tube having a plurality of separate cells and a method for efficiently manufacturing the multi-cell tube. More specifically, the present invention is characterized in that a plurality of separate cells can be simultaneously filled with fluid and the respective cells filled with the fluid are formed to be individually airtight when they are successively and repeatedly formed in a longitudinal direction of a tube, and that even though the fluid leaks out from any one of the cells due to a burst or breakage thereof, the other cells can be kept airtight.

BACKGROUND ART

In general, various kinds of tubes for accommodating gas or liquid therein are typically formed with only one cell. If necessary, a plurality of cells may be formed in the tube by dividing the tube into the multiple cells.

In all cases, the single cell should have at least one inlet (or inlet and outlet). Further, if the single tube is divided into the multiple cells, it is common that each cell is constructed to have one inlet belonging thereto.

For example, a bolster constructed to accommodate air therein can be manufactured such that an entire tube T of the bolster is formed with a single cell as shown in FIG. 17 or is divided into a plurality of cells as shown in FIG. 18. At this time, it is apparent that a single air inlet V is formed in the single-cell tube while each cell of the multi-cell tube has a single air inlet V belonging thereto.

In use, in a case where the entire tube T of the bolster is formed with only one cell as shown in FIG. 17, it is easy to let the air into or out of the tube. However, when a user rests his/her head on the bolster, air residing in a portion of the tube pressed down by his/her head is moved to the other portions of the tube. Thus, there is a problem in that the bolster does not fulfill its own proper function. In particular, if any portion of the tube bursts open, whole air in the tube leaks out, and thus, an inherent function of the bolster is completely lost.

In addition, in a case where the tube T is formed with the plurality of cells as shown in FIG. 18, it is inconvenient in that the air should be let into and out of the respective cells one by one. However, when the user rests his/her head on the bolster, the air residing in the portion of the tube pressed down by his/her head is moved to the other portions of the tube. Thus, there is convenience of use in that the head is not rocked. Furthermore, even though any portion of the tube bursts open, all the whole air in the tube does not fully leak out, and thus, the bolster does not completely lose its own inherent function.

Similarly, the above principle is also applied to a tank other than the tube.

For instance, in a case where an oil tanker is formed with a tank having a single cell for accommodating oil therein, it is very convenient to let the oil into and out of the tank, but the whole quantity of the oil within the tank inevitably leaks out when the oil begins to leak out in an emergency. Alternatively, in a case where the tank of the oil tanker is formed with a plurality of divided cells, the other cells are kept airtight even though any one cell is broken. Thus, a relatively small amount of oil can leak out from the tank, but it is very inconvenient to let the oil into and out of the tank.

DISCLOSURE OF INVENTION

Therefore, the present invention is conceived to solve the problems in the prior art. A primary object of the present invention is to manufacture a tube having two or more cells, which are repeatedly formed in longitudinal and circumferential directions of the tube, so that fluid can be separately or simultaneously let into and/or out of the respective cells and the respective cells can be individually kept airtight.

Further, another object of the present invention is to efficiently manufacture a tube in which a plurality of cells are successively and repeatedly formed in longitudinal and circumferential directions of the tube so that the productivity thereof can be improved.

According to an aspect of the present invention for achieving the above objects, there is provided a multi-cell tube, comprising: a cell unit including a plurality of cells which are arranged in a longitudinal direction of the tube and have corresponding inlets formed in a direction intersecting with the direction in which the cells are arranged; a supply tube unit which has an opening/closing valve at any one side end thereof and communicates with the inlets of all the cells in a state where the supply tube unit is close to the cells; and an operating tube unit which is installed within the supply tube unit, is positioned in vicinity of the inlets of the cells, and has an opening/closing valve at any one side end thereof.

BEST MODE FOR CARRYING OUT THE INVENTION

Hereinafter, preferred embodiments of a multi-cell tube according to the present invention will be described in detail with reference to the accompanying drawings.

Embodiment 1

Figure 1:
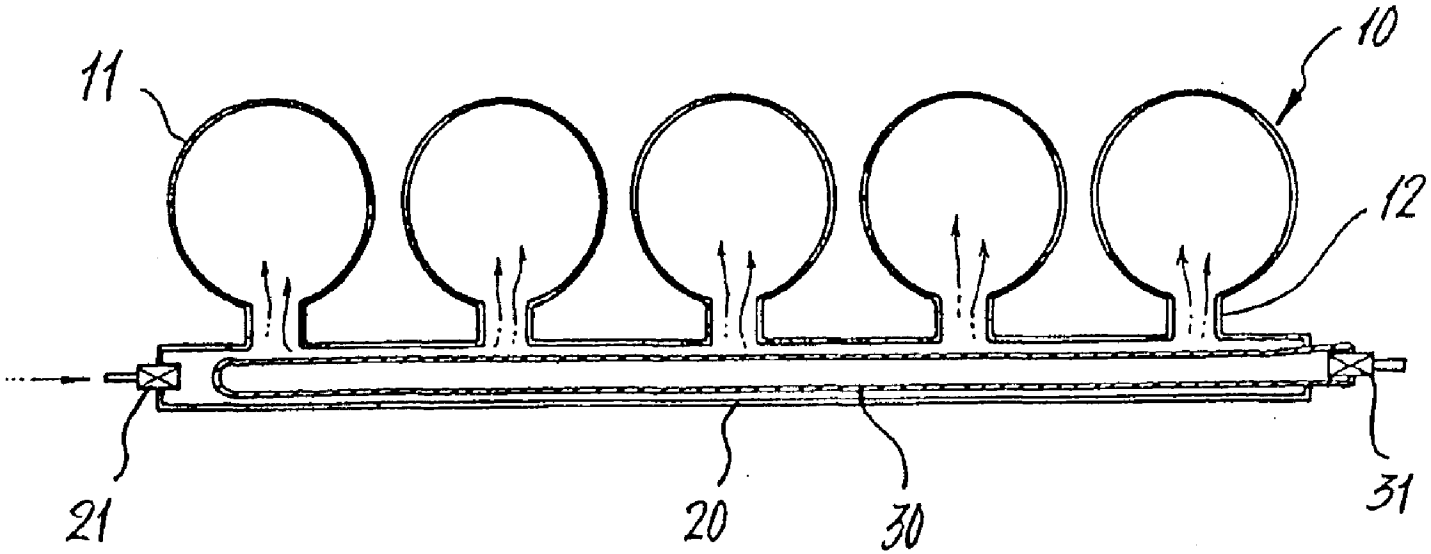
FIG. 1 is a sectional view showing the basic constitution of a multi-cell tube according to the present invention (in a state where fluid can be injected into cells of the tube).
Figure 2:
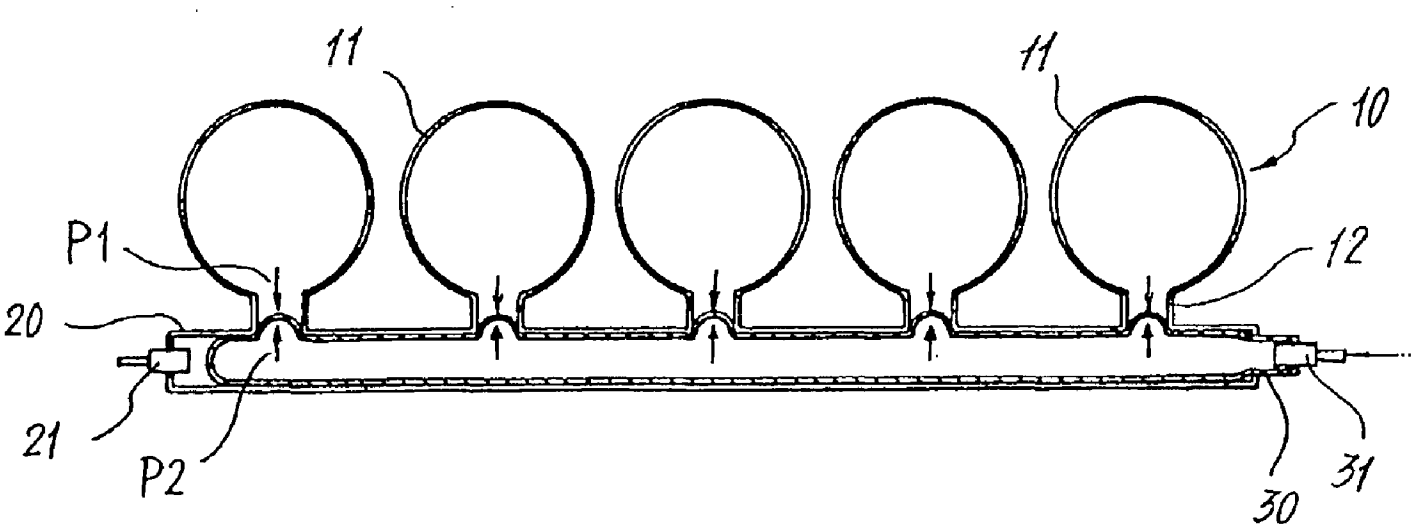
FIG. 2 is a sectional view showing the basic constitution of the multi-cell tube according to the present invention (in a state where the cells of the tube can be hermetically sealed).

FIG. 1 is a sectional view showing the constitution of a multi-cell tube according to a basic embodiment of the present invention, and FIG. 2 is a sectional view showing a state where the multi-cell tube of FIG. 1 is operated.

The multi-cell tube is mainly divided into a cell unit 10, a supply tube unit 20, and an operating tube unit 30.

As shown in the figures, the cell unit 10 is composed of a plurality of cells 11 which are arranged in a direction of the tube, and each of the cells 11 has an inlet 12 formed in a direction intersecting with the direction in which the cells are arranged.

The supply tube unit 20 is formed to extend long in the same direction as the arrangement of the cells 11, communicates with the inlets 12 of all the cells in a state where it is close to the cells, and has an opening/closing valve 21 at any one side end thereof.

The operating tube unit 30 is disposed adjacent to the inlets 12 of the cells 11 in a state where it is installed within the supply tube unit 20, and also has an opening/closing valve 31 at any one side end thereof.

The operation of the multi-cell tube of the present invention constructed as such is performed by first supplying a fluid to be filled into the cells to the supply tube unit 20 through the opening/closing valve 21 thereof.

The fluid filled into the supply tube unit 20 is introduced into the cells 11 through the inlets 12 of the cells 11. After the cells 11 have been completely filled with the fluid, another fluid (e.g., air) capable of inflating the operating tube unit 30 is introduced into the operating tube unit 30 through the opening/closing valve 31 thereof.

Thereafter, the fluid filled into the operating tube unit 30 causes the operating tube unit 30 to be inflated as shown in FIG. 2. Thus, the operating tube unit 30 installed within the supply tube unit 20 can close the cells 11 since the inflated portions thereof located adjacent to the inlets 12 come into uniform and close contact with the inlets 12.

At this time, assuming that pressure within the operating tube unit 30 and the cells 11 is P2 and P1, respectively, a pressure condition of P2>P1 must be maintained. However, there is no great problem in that the pressure condition can be maintained by simply closing the opening/closing valve 31 after sufficiently supplying the fluid into the operating tube unit 30 so as to increase the pressure therein.

It is expected that the multi-cell tube of the present invention can be practically employed in a cargo tank of an oil tanker, a ship, a fuel tank of an airplane, etc.

That is, a space within the oil tanker for accommodating the oil therein is divided into the plurality of cells, and the respective cells are filled with the oil. At this time, the cells can be simultaneously filled with the oil and simultaneously opened and closed using the supply tube unit and the operating tube unit as described above.

According to such a constitution of the present invention, although the multi-cell tube has the plurality of cells, it is not necessary to provide one valve to every cell. Further, the multi-cell tube of the present invention is convenient in that when the same kind of oil is filled or loaded into the cells, it can be simultaneously let into or out of the cells.

In particular, according to the constitution of the present invention, the respective cells can be individually kept airtight. Thus, even though any one of the cells may be broken due to shipwreck, it does not have any influence on the other adjacent cells in view of their airtight characteristics. Consequently, there is an advantage in that environmental pollution, casualties, and financial loss are reduced since the oil leakage can be minimized.

Embodiment 2

Figure 3:
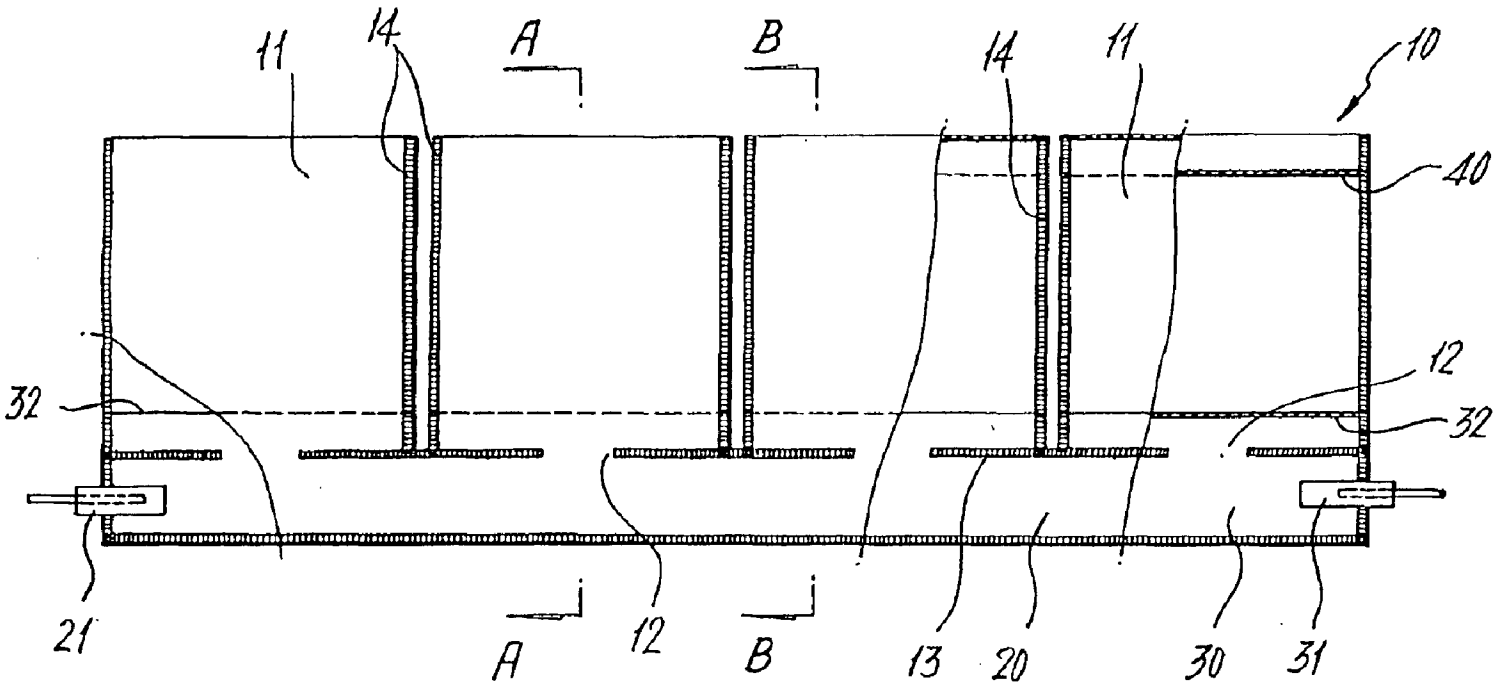
FIG. 3 is a front view showing the constitution of a multi-cell tube according to another preferred embodiment of the present invention.
Figure 4:
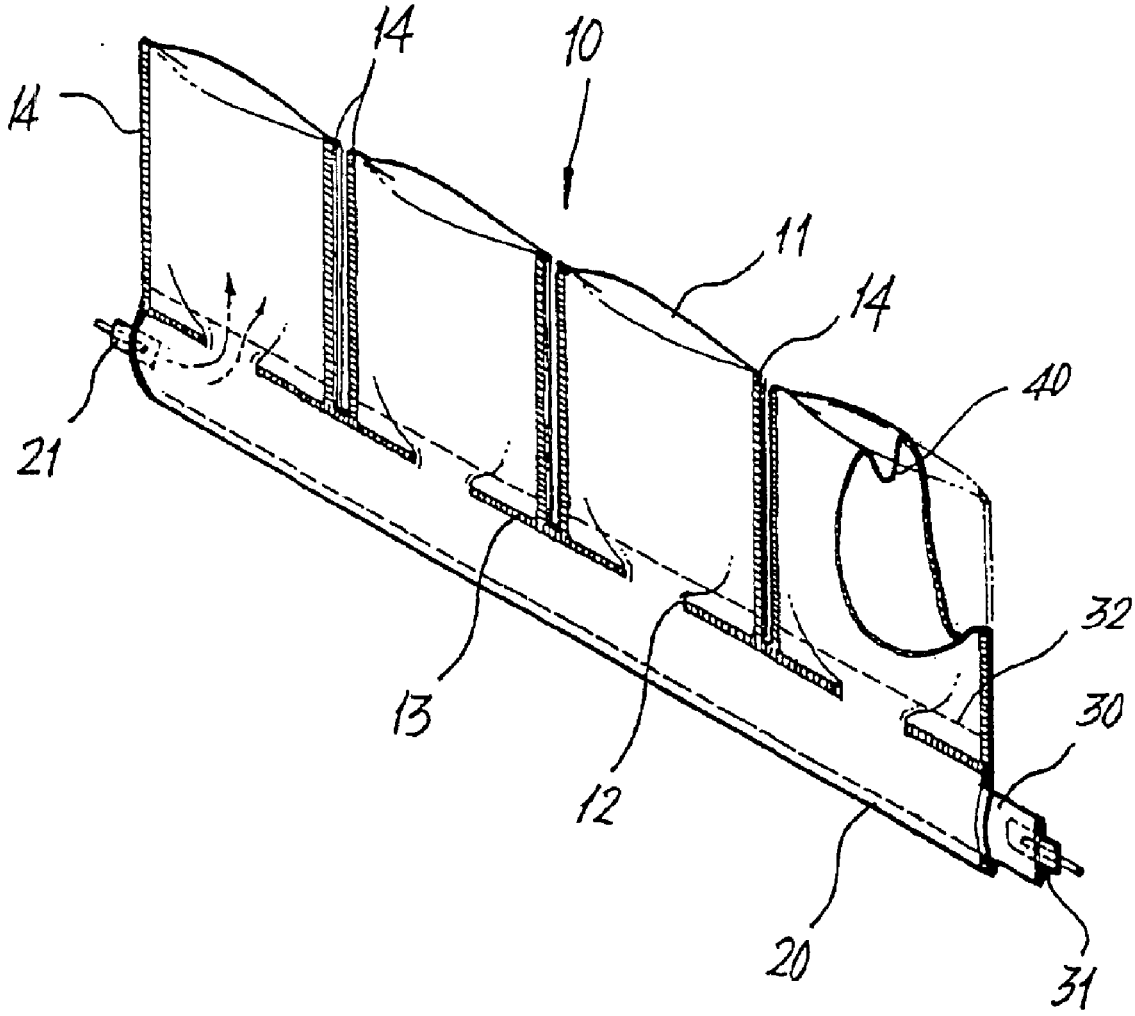
FIG. 4 is a perspective view showing the constitution of the multi-cell tube according to the preferred embodiment of the present invention.
Figure 5:
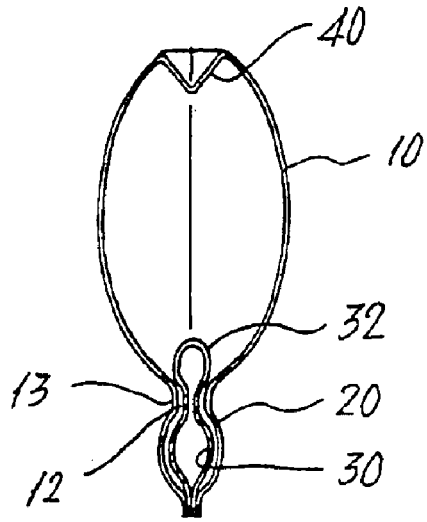
FIG. 5 is a sectional view taken along line A—A of FIG. 3.
Figure 6:
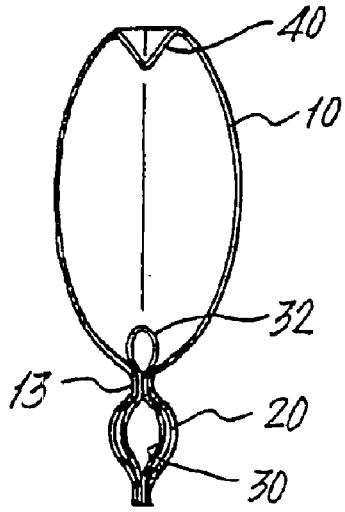
FIG. 6 is a sectional view taken along line B—B of FIG. 3.
Figure 7:
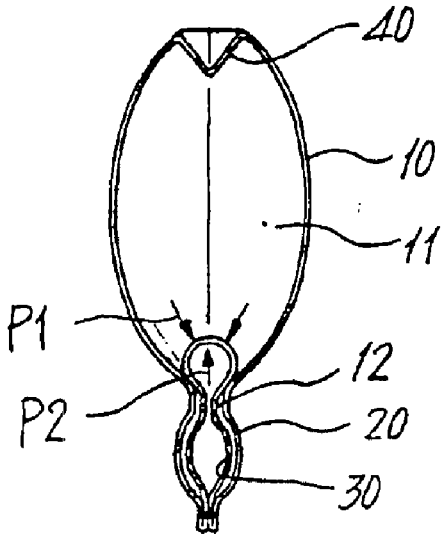
FIG. 7 is a view showing a state where the multi-cell tube shown in FIG. 5 is operated.

FIG. 3 is a front view showing the constitution of a multi-cell tube according to another preferred embodiment of the present invention, and FIG. 4 is a perspective view of the multi-cell tube shown in FIG. 3.

As shown in the figures, the multi-cell tube according to this embodiment of the present invention is mainly divided into the cell unit 10, the supply tube unit 20, and the operating tube unit 30 in the same manner as the previous embodiment. This embodiment is characterized in that all the units are integrally formed from a hollow cylindrical sheet of material 1, i.e. a hollow cylindrical sheet of synthetic resin material (e.g., PE, PP or the like, hereinafter referred to as "synthetic resin material") in order to manufacture the units in a most efficient manner.

The supply tube unit 20 and the cell unit 10 are separated from each other by division line sections 13 which are formed by fusion welding of intermediate portions of the hollow cylindrical material 1. Further, the operating tube unit 30, which is formed by inwardly folding a portion of the cylindrical material 1 and then inserting the folded portion into the cylindrical material 1, is provided in the supply tube unit 20. That is, the operating tube unit 30 is finally formed by fusion welding of an outer end of the inwardly folded portion in a state where the inwardly folded portion is overlapped with an inner side of the remaining portion of the cylindrical material.

At this time, it is essential that a plurality of inlets 12 should be formed between the division line sections 13 so that the supply tube unit 20 can communicate with the respective cells 11 through the inlets 12. Furthermore, the division line sections 13 are preferably formed in such a manner that an extension portion 32 corresponding to a part of the inwardly folded portion protrudes into the cell unit 10 so that the operating tube unit 30 can effectively close up the inlets when inflated.

In addition, the cell unit 10 is divided into the plurality of cells 11 by repeatedly forming a plurality of partition line sections 14 within ranges of the division line sections 13.

The supply tube unit 20 and the operating tube unit 30 are provided with valves 21, 31, respectively. Flat valves can be used as the valves 21, 31.

The flat valve includes a valve plate a formed to prevent inside pressure from leaking out when a sheet of the synthetic resin material (e.g., elastic vinyl etc.) is folded into two to come into close surface contact with each other, and a straw b inserted into the valve plate for allowing the air to be let into and out of the units. The flat valve is bonded to the units by the fusion welding process so that inner and outer ends thereof are positioned inside and outside the units, respectively.

Hereinafter, a method of manufacturing the multi-cell tube according to this embodiment of the present invention will be explained.

In order to manufacture the multi-cell tube of the present invention using a sheet of the cylindrical material 1 made of the synthetic resin material, a material preparation process, a folding process, a dividing process, and a valve attachment process will be performed.

Figure 8:
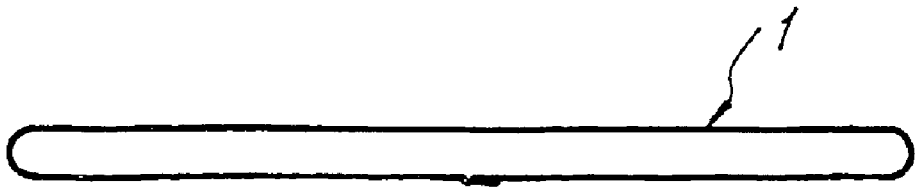
FIG. 8 is a sectional view illustrating a first step of a method for manufacturing a multi-cell tube according to the present invention.

In the material preparation process, either a preformed cylindrical synthetic resin material or a cylindrical synthetic resin material 1 formed by bonding both ends thereof is prepared, as shown in FIG. 8.

At this time, it is apparent that width and length of the synthetic resin material are determined depending on the sizes and number of the multi-cell tubes which are intended to be manufactured.

Figure 9:
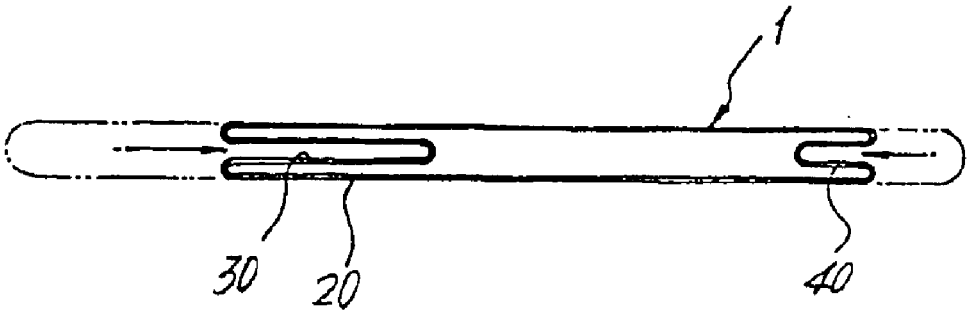
FIG. 9 is a sectional view illustrating a second step of the method for manufacturing the multi-cell tube according to the present invention.
Figure 10:
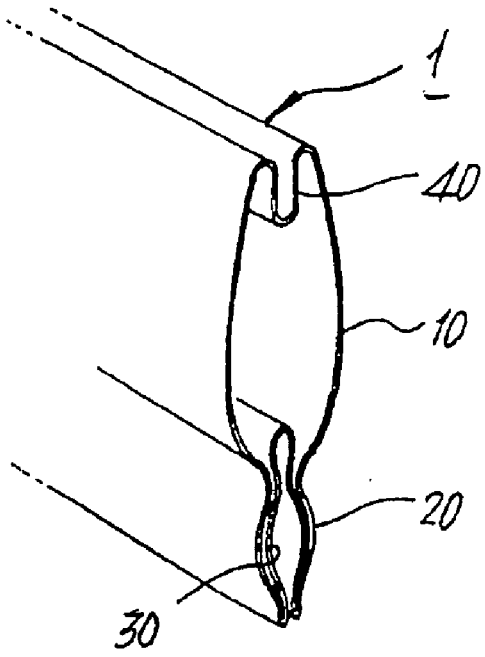
FIG. 10 is a perspective view illustrating the second step of the method for manufacturing the multi-cell tube according to the present invention.

In the folding process, the cylindrical synthetic resin material obtained from the material preparation process is flatly folded. Then, as shown in FIG. 9, one side end (right portion in the figure) of the cylindrical material in a widthwise direction is inwardly folded and inserted into the remaining portion thereof so that a unit 40 for defining a three-dimensional structure can be prepared beforehand. Further, the other side end (left portion in the figure) of the cylindrical material in the widthwise direction is also inwardly folded and inserted into the remaining portion thereof so that portions to be formed into the supply tube unit 20 and the operating tube unit 30 are beforehand prepared.

In the division process, the division line sections 13 and the partition line sections 14 are formed in a state where the multi-cell tube is folded as in the folding process.

Figure 11:
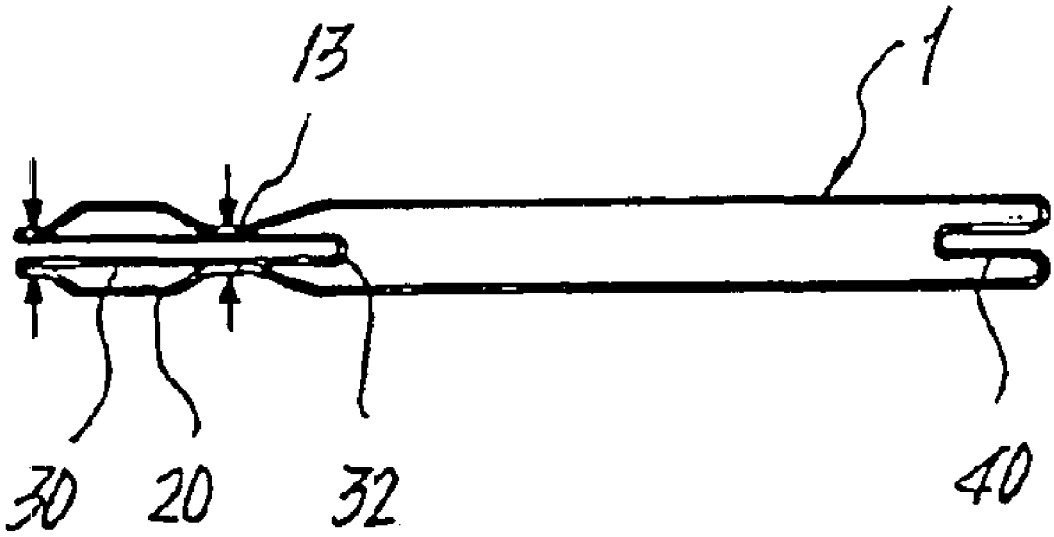
FIG. 11 is a sectional view illustrating a third step of the method for manufacturing the multi-cell tube according to the present invention.

That is, as shown in FIG. 11, both ends of the portions, which was inwardly folded and inserted into the remaining portion thereof to be formed into the supply tube unit 20 and the operating tube unit 30, are bonded through the fusion welding process so that the supply tube unit 20 and the operating tube unit 30 are completed.

Figure 12:
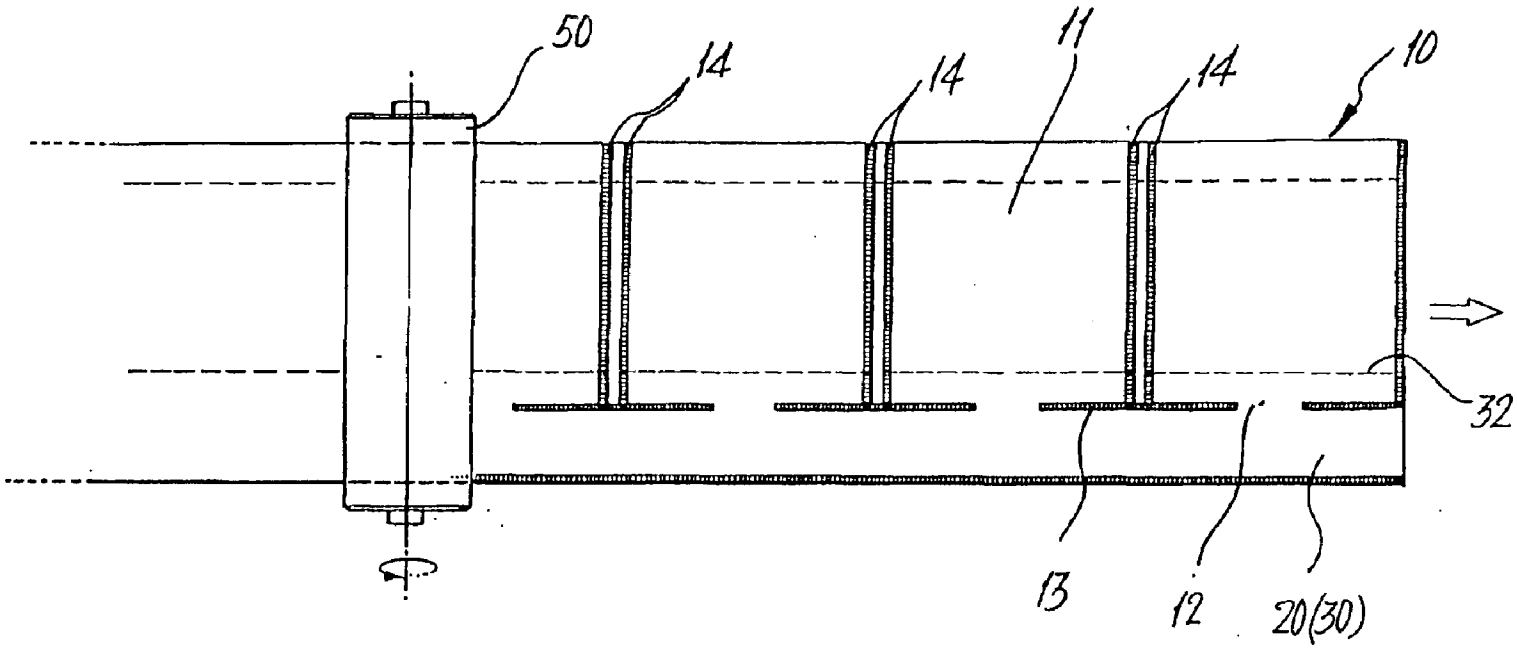
FIG. 12 is a plan view illustrating the third step of the method for manufacturing the multi-cell tube according to the present invention.

Further, if such a division process is to be performed successively in a direction in which the cells are arranged, it is preferred that the division line sections 13 and the partition line sections 14 be formed successively and repeatedly using a heating roller 50 as shown in FIG. 12.

At this time, since portions which are not bonded, i.e. the inlets 12, should be formed between the division line sections 13, it is preferred that the roller be manufactured so that each of the inlets 12 can be formed at a position corresponding to the center of a width of each cell 11.

Figure 13:
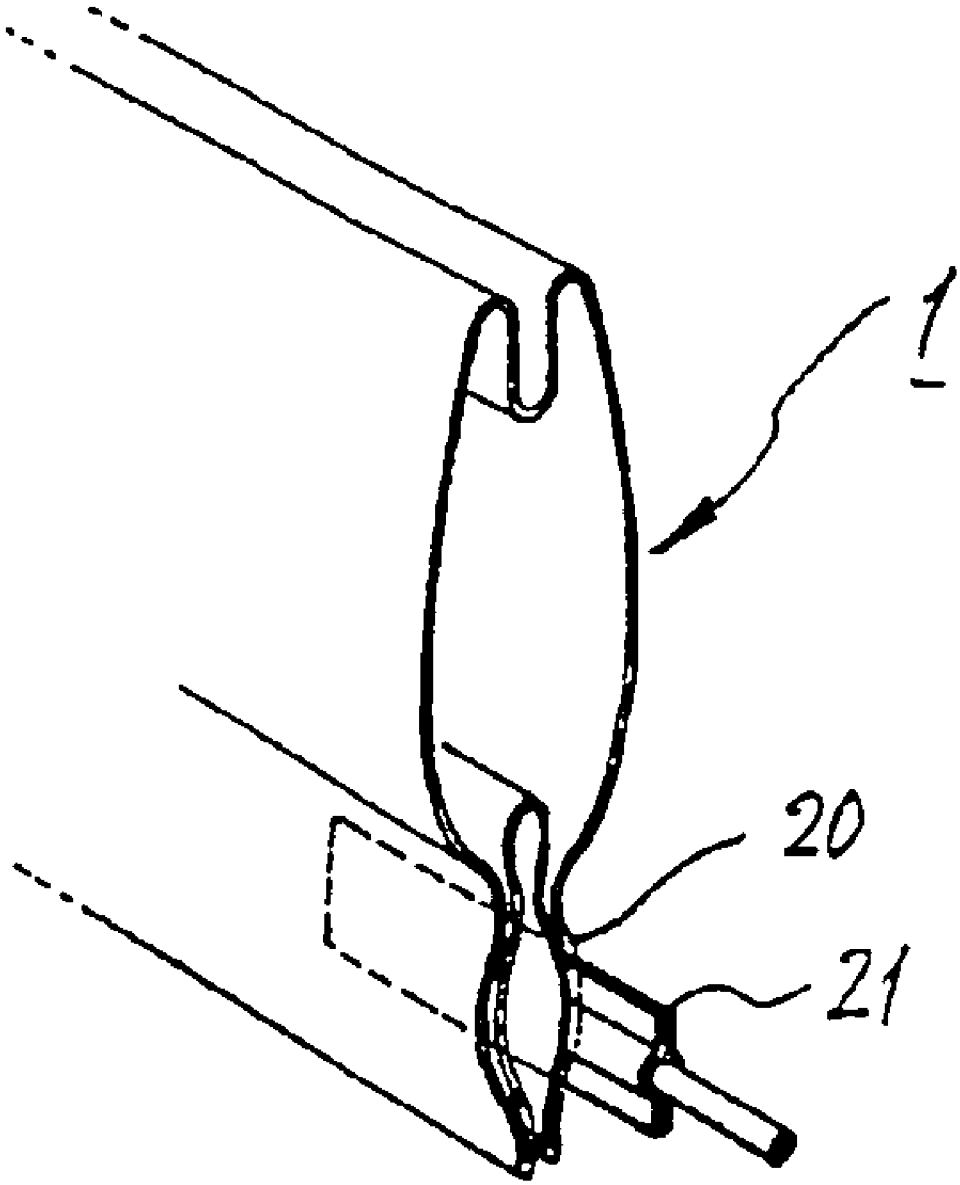
FIG. 13 is a perspective view illustrating a fourth step of the method for manufacturing the multi-cell tube according to the present invention.
Figure 14:
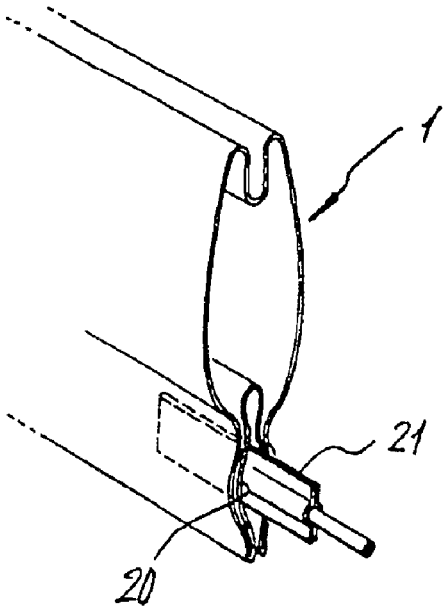
FIG. 14 is a perspective view illustrating a fifth step of the method for manufacturing the multi-cell tube according to the present invention.

In the valve attachment process, after the cells 11 of the cell unit 10, the supply tube unit 20, and the operating tube unit 30 have been formed through the division process, the opening/closing valve 21 is attached to the one side end of the supply tube unit 20 as shown in FIG. 13 while the opening/closing valve 31 is also attached to the one side end of the operating tube unit 30 as shown in FIG. 14.

After the valve attachment process has been completed as such, the predetermined fluid can be supplied into the supply tube unit 20 through the opening/closing valve 21 for use in the supply tube unit 20. The fluid to be supplied is introduced into the respective cells 11 through the corresponding inlets 12 as shown in the left of FIG. 4.

After the supply of the fluid has been completed, another fluid is introduced into the operating tube unit 30, which is in turn inflated. In particular, since the extension portion 32 of the operating tube unit 30 protrudes into the cells 11, simultaneous inflation of the extension portion 32 allows the inlets 12 to be closed up effectively and completely.

Consequently, since the pressure P2 within the operating tube unit 30 and the extension portion 32 thereof protruding into each of the cells 11 is greater than the pressure P1 within the cell 11, the fluid supplied into every cell 11 does not leak out unless the inlets 12 are opened due to reduction of the fluid pressure within the operating tube unit 30. Even though any one of the cells 11 bursts open in such an airtight state, the fluid cannot leak out from the other cells 11 since all the cells are individually kept airtight.

Embodiment 3

The present invention may be implemented to include a plurality of cell units 10 at a single supply tube unit 20 in three, four or more directions by improving the structure of Embodiment 2.

Figure 15:
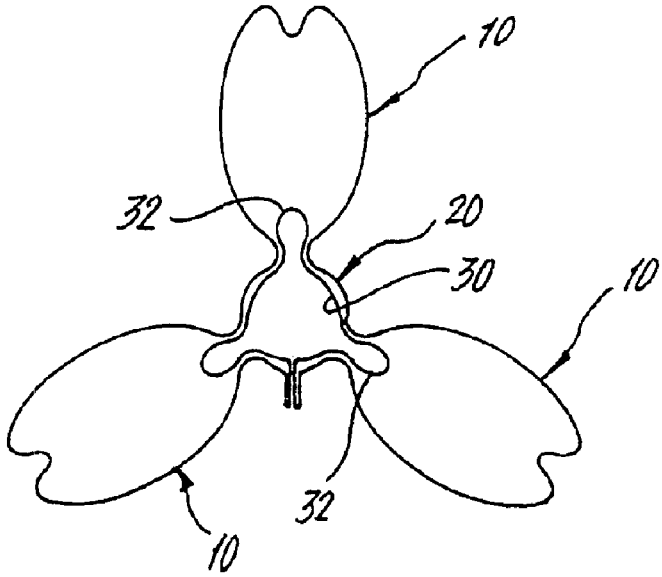
FIG. 15 is a sectional view showing the constitution of a multi-cell tube according to a further preferred embodiment of the present invention.
Figure 16:
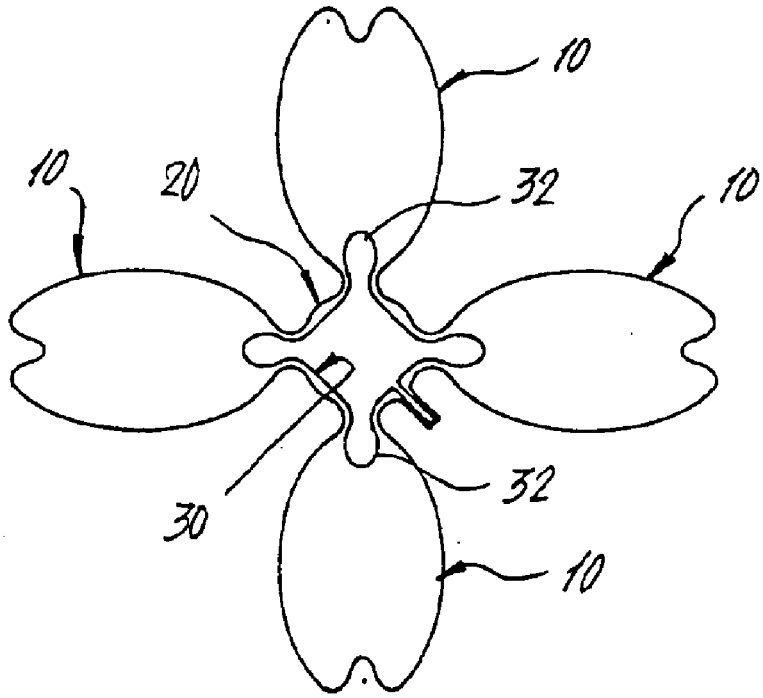
FIG. 16 is a sectional view showing the constitution of a multi-cell tube according to a still further preferred embodiment of the present invention.
Figure 17:
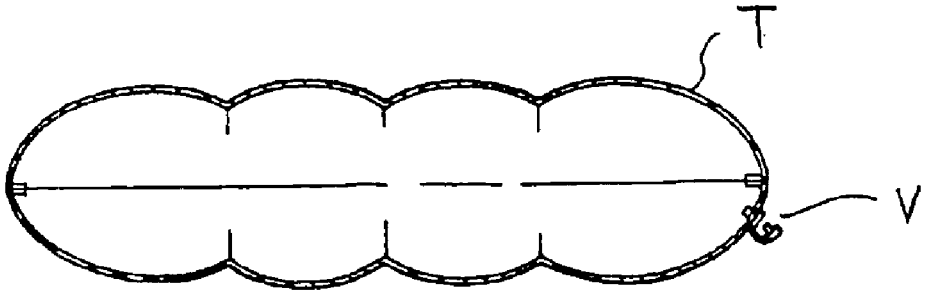
FIG. 17 is an exemplary view of a general tube according to a prior art.
Figure 18:
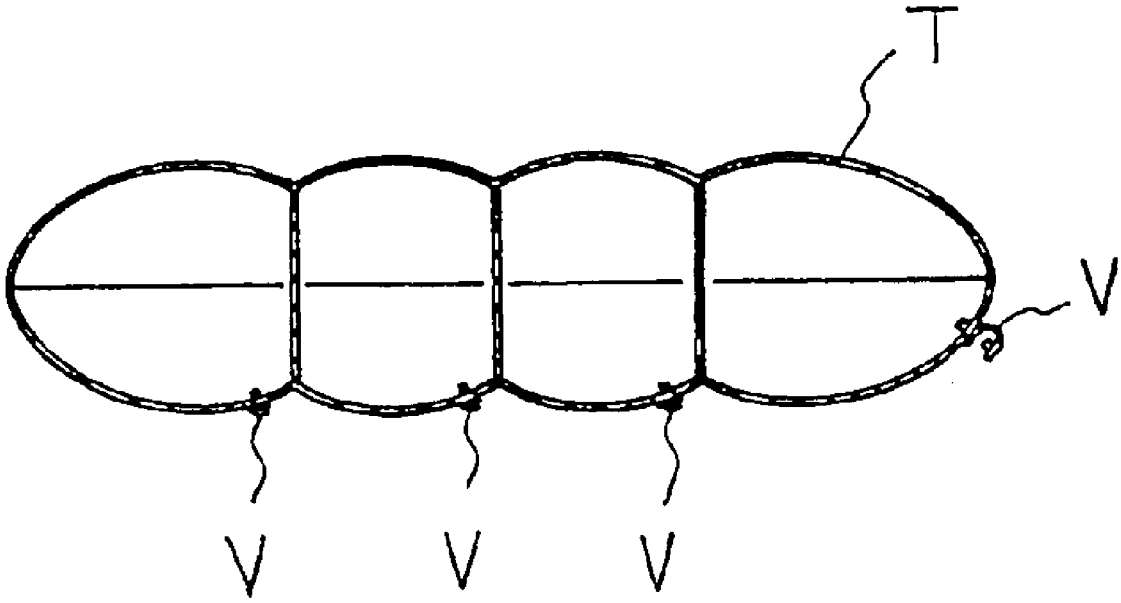
FIG. 18 is an exemplary view of a multi-cell tube according to the prior art.

That is, as shown in FIGS. 15 and 16, the plurality of cell units 10 can be simultaneously formed at an angular interval such as about 90 or 120 degrees around the single supply tube unit 20 centrally positioned among the cell units.

A multi-cell tube according to this embodiment of the present invention is also manufactured in the same manner as Embodiment 2, but should be manufactured by successively performing an improved folding process of folding the single cylindrical material 1 to be formed into the units, and an improved division process of forming the division line sections 13 and the partition line sections 14 belonging to the units.

Further, since the cell units 10, the supply tube unit 20 and the operating tube unit 30 of the multi-cell tube of the present invention are successively and repeatedly manufactured in a longitudinal direction of the cylindrical material 1, the multi-cell tube cut at desired lengths can be individually used. And then, the multi-cell tube can be completed by bonding thereto the opening/closing valve 21 for the supply tube unit 20 and the opening/closing valve 31 for the operating tube unit 30.

As described in detail above, the multi-cell tube according to the present invention is constructed such that the respective cells are separately formed and arranged, the fluid can be simultaneously let into and out of the respective cells, and the respective cells can be individually kept airtight. Therefore, even though any one of the cells bursts open or is damaged, all the other cells can be kept airtight.

Accordingly, since the fluid leakage due to the probable damage to the cells can be restricted and minimized to the relevant cells, it can contribute to the protection of environment. Further, the casualties can be reduced when the multi-cell tube of the present invention is employed in water toys, rubber boats and the like. Furthermore, convenience of life is improved since various kinds of chair cushions and air beds/mattresses can be made using the multi-cell tube.

Reference Numerals for Designating Main Components in the Drawings

1: Material
10: Cell portion

11: Cell
12: Inlet
13: Division line section
14: Partition line section
20: Supply tube unit
21: Opening/closing valve
30: Operating tube unit
31: Opening/closing valve
32: Extension portion
40: Portion for defining three-dimensional structure
50: Roller

What is claimed is:

1. A method of manufacturing a multi-cell tube, comprising:

a material preparation step of preparing a preformed cylindrical synthetic resin material or a cylindrical synthetic resin material formed by bonding both ends thereof;

a folding step of preparing a portion (40) for defining a three-dimensional structure by inwardly folding and inserting one side end of the cylindrical material into the remaining portion thereof after flatly folding the cylindrical synthetic resin material prepared in the material preparation step, and preparing portions to be formed into the supply tube unit (20) and the operating tube unit (30) by inwardly folding and inserting the other side end of the cylindrical material into the remaining portion thereof;

a division step of forming division line sections having inlets along a direction in which the cells are arranged so that the supply tube unit and operating tube unit prepared in the folding step can be formed, and repeatedly forming partition line sections along a direction intersecting with the direction in which the cells are arranged; and a valve attachment step of attaching opening/closing valves to one side ends of the supplying tube unit and the operating tube unit prepared in the division step, respectively, and sealing opposite side ends of the units.

2. The method as claimed in claim 1, wherein in the division step, the division line sections and the partition line sections are formed by a fusion welding means.

3. The method as claimed in claim 2, the fusion welding means includes a fusion welding roller used for successively and repeatedly forming the division line sections and the partition line sections in the direction in which the cells are arranged.

* * * * *